US011673775B2

(12) United States Patent
Zimmer

(10) Patent No.: US 11,673,775 B2
(45) Date of Patent: Jun. 13, 2023

(54) VEHICLE CRANE AND METHOD FOR REDUCING THE LOADING ON ITS JIB

(71) Applicant: Tadano Demag GmbH, Zweibrücken (DE)

(72) Inventor: Walter Zimmer, Sulzbach (DE)

(73) Assignee: Tadano Demag GmbH, Zweibrücken (DE)

( * ) Notice: Subject to any disclaimer, the term of this patent is extended or adjusted under 35 U.S.C. 154(b) by 28 days.

(21) Appl. No.: 17/231,298

(22) Filed: Apr. 15, 2021

(65) Prior Publication Data

US 2021/0323796 A1 Oct. 21, 2021

(30) Foreign Application Priority Data

Apr. 16, 2020 (DE) ..... 102020110369.7
Oct. 19, 2020 (DE) ..... 102020127429.7

(51) Int. Cl.
*B66C 23/36* (2006.01)
*B66C 23/82* (2006.01)
*B66C 23/76* (2006.01)

(52) U.S. Cl.
CPC ..... *B66C 23/36* (2013.01); *B66C 23/826* (2013.01); *B66C 23/76* (2013.01); *B66C 2700/0371* (2013.01)

(58) Field of Classification Search
CPC ..... B66C 23/36; B66C 23/60; B66C 23/62; B66C 23/821; B66C 23/823
See application file for complete search history.

(56) References Cited

U.S. PATENT DOCUMENTS 6,499,611 B1 * 12/2002 Franzen ..... B66C 23/82 212/196
7,252,203 B2 8/2007 Frankenberger et al.
2015/0203338 A1 * 7/2015 Albinger ..... B66C 23/70 212/347
2016/0221799 A1 * 8/2016 Muench ..... B66C 23/62
(Continued)

FOREIGN PATENT DOCUMENTS

DE 2506914 A1 1/1976
DE 10155006 A1 5/2003
DE 20215179 U1 2/2004
(Continued)

*Primary Examiner* — Michael R Mansen
*Assistant Examiner* — Juan J Campos, Jr.
(74) *Attorney, Agent, or Firm* — Gardner, Linn, Burkhart & Ondersma LLP

(57) ABSTRACT

A vehicle crane comprising a jib that is raised and lowered by at least one main tensile connector, and a counter jib, where the main tensile connector extends between a first connecting point in the region of a jib head and a second connecting point in the region of a counter jib head. To reduce loading on the jib, in particular during raising and lowering and increase its bearing load overall, the jib has a third connecting point between the first connecting point and its foot opposite the head, and a secondary tensile connector extends between the third connecting point and a fourth connecting point in the region of the head of the counter jib, or the secondary tensile connector extends between the third connecting point via a seventh connecting point on the main tensile connector and a fourth connecting point in the region of the main jib foot.

20 Claims, 7 Drawing Sheets

(56) References Cited

U.S. PATENT DOCUMENTS

| | | | | |
|---|---|---|---|---|
| 2018/0029853 | A1* | 2/2018 | Hamaguchi | B66C 23/88 |
| 2019/0144247 | A1* | 5/2019 | Albinger | B66C 13/16<br>701/50 |

FOREIGN PATENT DOCUMENTS

| | | | |
|---|---|---|---|
| DE | 102010022256 | A1 | 12/2010 |
| DE | 102017117121 | A1 | 2/2018 |
| DE | 102018114832 | A1 | 12/2019 |
| JP | 2011219213 | A | 11/2011 |

* cited by examiner

S2

S2

VEHICLE CRANE AND METHOD FOR REDUCING THE LOADING ON ITS JIB

CROSS REFERENCE TO RELATED APPLICATION

The present application claims the priority benefits of German Application Nos. DE 10 2020 110 369.7, filed on Apr. 16, 2020, and DE 10 2020 127 429.7, filed on Oct. 19, 2020.

BACKGROUND AND FIELD OF THE INVENTION

The invention relates to a vehicle crane comprising a jib that can be raised and lowered by at least one main tensile connector, and a counter jib, wherein the main tensile connector extends between a first connecting point in the region of a head of the counter jib and a second connecting point in the region of a head of the counter jib. The invention also relates to a method for reducing loading which occurs in its jib during operation and/or during raising and lowering.

In addition to the type of running gear unit (wheeled running gear unit/crawler track), vehicle cranes differ from one another primarily in terms of the design of their jib which can be luffed vertically about the foot-side support. Telescopic configurations, i.e. configurations that are variable in length, typically have for this purpose a luffing mechanism, in which the luffing is based upon a linear drive which produces a compressive force. In contrast, non-telescopic forms, such as for instance configurations constructed on truss or lattice girders, have at least one guying arrangement, in which the empty weight proportion made up of a tensile force, which can be transmitted by a main tensile connector in the region of the jib head, permits raising and lowering of the jib.

In the case of long lengths, the empty weight of such a jib produces heavy loading even during its raising and lowering phase. Its section which is unsupported between its foot and the main tensile connector acting in the head region ensures a corresponding bending moment. This is supplemented by the normal force proportion from the main tensile connector which extends obliquely with respect to the jib longitudinal axis, which normal force proportion is added disadvantageously to the compressive force proportion of the bending moment and even increases this by reason of sagging.

German laid-open document DE 10 2018 114 832 A1 discloses a large crane for assembling wind turbines. In the case of a height of a hub of a wind turbine of 200 m, a hook height of the large crane of 210 m is required. The large crane is designed as a crawler crane comprising a main jib which is luffably arranged on a superstructure and is divided approximately in the centre into a first portion and a second portion. The first and the second portion are connected to one another in a foldable manner for raising and lowering the main jib. Moreover, a long auxiliary jib is luffably arranged on the main jib. For the purpose of raising, lowering and luffing the main jib, a main tensile connector is secured on the end side in the region of a jib head of the first portion of the main jib. Oppositely, the main tensile connector is supported on a head of a counter jib which is articulated on the superstructure of the large crane which can be pivoted about a vertical axis. A tensile force applied to the main tensile connector serves to raise, lower or luff the first portion of the main jib accordingly. Furthermore, auxiliary tensile connector are provided which extend spaced apart from one another between the first portion of the main jib and the main tensile connector. The arrangement of the auxiliary tensile connector counteracts sagging, which occurs by reason of the empty weight, and the associated bending loading of the main jib. The invariable position and length of the auxiliary tensile connector represents a compromise between the loading scenarios which occur during operation and the raising and lowering phase of the main jib. An increase in jib length means that its empty weight is inevitably increased and the loading resulting therefrom reduces the bearing load which remains for operation. With regard to the increasing demand for ever increasing working radii and increasing jib lengths, the currently known configurations cannot adequately cope with said loading scenarios.

Furthermore, German laid-open document DE 101 55 006 A1 already discloses a comparable vehicle crane comprising a so-called superlift device. A superlift device consists substantially of a bearing load-increasing additional counterweight which is suspended from the head of the counter jib. Horizontal spacing between the axis of rotation of the superstructure and the centre of gravity of the additional counterweight is referred to as the additional counterweight radius. In a corresponding manner, the horizontal spacing between the axis of rotation of the superstructure and the centre of gravity of a load to be handled is the loaded radius. In the case of a lifting task which is to be performed, the loaded radius when a load is being picked up is generally different to the loaded radius when the load is being put down. In order to react to this, e.g. the additional weight radius can be adjusted by retracting or extending a telescoping rod between the additional weight and the superstructure. In order to accomplish a pending lifting task, the crane operator receives assistance via an indication of the loaded radius, the additional counterweight radius, the load currently picked up as well as the bearing load table associated with the set-up state of the vehicle crane. This bearing load table or the bearing load diagram shows the permissible upper and lower limits of the load to be handled at a given loaded radius and specified magnitude of the additional counterweight in dependence upon the additional counterweight radius.

SUMMARY OF THE INVENTION

The present invention provides a vehicle crane that further reduces the loading that acts upon its jib, in particular during raising and lowering, including in order to increase its bearing load overall. Furthermore, a method is provided for reducing the loading which occurs in the jib during operation and/or during raising and lowering.

In accordance with an embodiment of the invention, a vehicle crane comprising a jib, which can be raised and lowered by at least one main tensile connector, and a counter jib, the main tensile connector extends between a first connecting point in the region of a head of the jib and a second connecting point in the region of a head of the counter jib, wherein the jib has a third connecting point located between the first connecting point and its foot opposite the head, and a secondary tensile connector extends between the third connecting point and a fourth connecting point in the region of the head of the counter jib or alternatively the secondary tensile connector extends between the third connecting point via a seventh connecting point on the main tensile connector and a fourth connecting point in the region of the foot of the main jib. The secondary tensile connector is configured such that a compensation force can be transmitted thereby to the jib. Therefore, in other words the jib is connected to the counter jib or the jib foot via an additional secondary tensile connector. By means of its coupling to a portion of the jib located between the foot and the first connecting point, its sagging arising from the empty weight can be compensated for at least partially.

The resulting advantage can be seen in the fact that the additional connection of the jib to the counter jib or the jib foot via the secondary tensile connector leads to an advantageous reduction in the bending load. In particular, the critical phase during raising and lowering to a substantially horizontal orientation of the jib, in which the unsupported length of the jib is at its greatest, is relieved considerably thereby. As a result, an aspect of the invention permits simpler raising and lowering of long and/or heavy jibs, wherein further increases can be achieved in particular in the length of the jib. Moreover, the bearing load for the operation of the vehicle crane can also be further increased in this manner.

The precise position of the third connecting point between the foot and the first connecting point, fifth connecting point, sixth connecting point, seventh connecting point and eighth connecting point, can be established by a person of skill in the art in which it is specified accordingly on the basis of measurements and/or calculations. Despite in part the individual configurations of the jibs of vehicle cranes, it is to be assumed that typically it will be necessary to arrange the third connecting point in a portion of the respective jib located centrally between the foot and the first connecting point. This non-limiting assessment is based upon the assumption that the weight of the jib per meter is substantially constant between its foot and the first connecting point such that the portion of the jib extending between the foot and third connecting point and the portion of the jib extending between the third and first connecting point are approximately the same weight. Possible differences in the weight progression and the resulting normal force progression of the jib and/or the bending moment produced from the overhang from the first connecting point towards its free head end will be taken into consideration accordingly by the person skilled in art in establishing the position of the third connecting point, fifth connecting point, sixth connecting point, seventh connecting point and eighth connecting point in order to achieve the smallest possible loading on the jib, in particular from bending moments.

According to one preferred embodiment of the basic inventive concept, the main tensile connector and also the secondary tensile connector can be variable in length. This means both the variability of e.g. only portions of its length and also the change in its length overall. Therefore, the main tensile connector or secondary tensile connector could be configured at least partially e.g. in terms of a pulley block in order to permit length variability per se. In this respect, it would be feasible to have a connection, which is fixed at one of its ends, to the first or third connecting point of the jib or the second or fourth connecting point respectively. As an alternative or in addition thereto, the connection of the main tensile connector and the secondary tensile connector to the counter jib could be configured in favour of a deflection thereon, wherein its length variability could then be based e.g. on a reduction in length by means of winding.

In addition to the thus possible "holding under tension" of the main tensile connector and the secondary tensile connector during a change in the orientation of the jib, said length variability of the secondary tensile connector offers the option of adapting the sought-after compensation for sagging caused by empty weight and normal force of the jib to changing states. This can be e.g. the orientation of the jib and the height of the suspended load. By means of a corresponding control, it is then possible to transmit the compensation force, which can be varied for optimum relieving of the loading, via the secondary tensile connector in order to advantageously counteract the respective sagging of the jib.

An aspect of the invention makes provision that the jib can extend preferably without joints between its foot and its head. In this case, the jib in accordance with the invention is itself understood to be a main jib and in this respect is not understood to be a collective term for a combination of such a main jib comprising an auxiliary jib. Even if the jib in terms of the invention can be equipped with an additional auxiliary jib connected in an articulated manner, the inventive embodiments and arrangements of the main tensile connector and the secondary tensile connector relate basically to the jib in terms of a main jib without joints. It is also feasible to equip the auxiliary jib additionally or only with the secondary tensile connector in accordance with the invention.

Provision is further made that the jib can be a one-part or multiple-part construction. In a particularly preferred manner, the jib is non-telescopic and so it cannot be varied in terms of its length by means of a corresponding drive. Possible changes in its length by the addition or removal of individual portions or segments do not fall within telescoping capability in terms of the invention. For instance, the jib can have an individual and, in this respect, one-piece girder which extends between the foot and the head of the jib. Alternatively, the jib can also have at least two girders in series. The at least one girder can be e.g. a box girder in terms of a hollow body, or can be a lattice girder having a correspondingly open or closed latticework. Moreover, mixed forms and combinations of the foregoing are also feasible.

In order to achieve flexibility in use, provision is made that the vehicle crane in accordance with an aspect of the invention can have a superstructure that is arranged so as to be rotatable on a lower carriage, wherein the jib is then supported on the superstructure in a luffable manner via its foot.

On this basis, it is considered to be advantageous if the counter jib is supported on the superstructure. Preferably, said support is effected in a moving form such that corresponding adaptations can be made in the orientation of the counter jib.

With regard to the advantageous length variability of the main tensile connector and the secondary tensile connector, the superstructure or the foot of the counter jib can have a winch drive, with which the main tensile connector and the secondary tensile connector are then operatively connected. This means e.g. that the secondary tensile connector can be wound and unwound at least partially in order to vary in particular the level of the required compensation force.

As a further way of compensating for the sagging caused by the empty weight and the normal force of the jib, it is considered to be advantageous within the scope of the invention if the jib has not only the first connecting point for the main tensile connector and the third connecting point for the secondary tensile connector but also at least one fifth connecting point which can then be coupled to an auxiliary tensile connector. Said auxiliary tensile connector is then connected by means of its opposite end to the main tensile connector. Preferably, the fifth connecting point can be located between the first connecting point and the third connecting point such that the auxiliary tensile connector extends in a region between the jib head and the secondary tensile connector between the jib and the main tensile connector.

In an advantageous manner, provision is made that the fifth connecting point is located between the first connecting point and the third connecting point on the jib.

Furthermore, it is advantageous that the region for the third connecting point, as seen in the longitudinal direction of the jib, is between 25% and 75%, preferably between 40% and 60%, of the length of the jib.

In one embodiment of the vehicle crane, an additional counterweight is suspended from the counter jib. Depending on the type of set-up of the vehicle crane, the counter jib is a superlift jib or an A-block. In this case, an A-block is typically used alone without a superlift jib on a vehicle crane or a superlift jib is used only together with the A-block. In the case of the type of set-up of an A-block without a superlift jib, the main tensile connector and, depending upon the design variant, also the secondary tensile connector, is articulated to the head of the A-block. In the case of the type of set-up of a superlift jib with an A-block, the main tensile connector and, depending upon the design variant, also the secondary tensile connector, is articulated to the head of the superlift jib.

The vehicle crane in accordance with the invention now presented allows it to be raised and lowered in a problem-free manner in spite of its extremely long and/or heavy jib. In particular, the configuration and arrangement of the secondary tensile connector contributes to extremely advantageous relieving of the loading on the jib. By changing the compensation force which can be transmitted via the secondary tensile connector, it is possible to adapt to all operating and/or set-up states of the vehicle crane, in which its jib can always be supported in an optimum manner. Moreover, the invention produces an increase in the bearing load of the vehicle crane and so its usage capability can be extended on the whole.

The invention is also directed to a method, by which the loading which occurs in the jib of a vehicle crane, which has a counter jib, during its operation and/or during the raising and lowering of the jib can be reduced. In addition to a first connecting point which is located in the region of a head opposite its foot and is coupled to a main tensile connector, the jib has in this case a further third connecting point which is located between the first connecting point and its foot. In accordance with the invention, a compensation force which in particular is controllable is transmitted to the jib by means of a secondary tensile connector coupled to this third connecting point. In a particularly preferred manner, the vehicle crane can be the previously described vehicle crane in accordance with the invention.

The resulting advantages have already been explained in greater detail in connection with the vehicle crane in accordance with the invention and so to avoid repetition reference is made at this juncture to the corresponding statements relating thereto.

The method in accordance with the invention also provides a control of the tensile force which is to be introduced and which can be effected in at least one of the ways stated hereinafter: force-controlled, path-controlled, continuously, constantly, linearly, stepwise.

In other words, the tensile force to be applied can be controlled or readjusted in that e.g. the changing force is detected at the secondary tensile connector from the jib. Therefore, an increasing force can be compensated for by a tensile force counteracting said increasing force, whereas in the event of a decreasing force the tensile force is reduced accordingly. In a similar manner, the movements which result during a change in the force can be utilized in order to ascertain therefrom and accordingly apply a tensile force level used for compensation purposes. The control can react linearly to any change with a change in the tensile force or else effect a change in the level of the tensile force to be applied only when the measured parameters move outside a range. Overall, the control can be effected preferably constantly and/or continuously in order to achieve shortest possible reaction times to changing influences. As an alternative or in addition to the foregoing, at least one of the features of the vehicle crane stated hereinafter can be taken into consideration during the control of the tensile force: bearing load points, loaded radius, counterweight radius, bearing load curve.

This essentially means taking into consideration the bearing load of the vehicle crane in dependence upon the orientation of its jib in a vertical plane and about a vertical axis relative to the lower carriage.

An exemplified embodiment of the invention will be explained in greater detail with reference to the following description and accompanying figures.

DESCRIPTION OF THE PREFERRED EMBODIMENT

Figure 1:
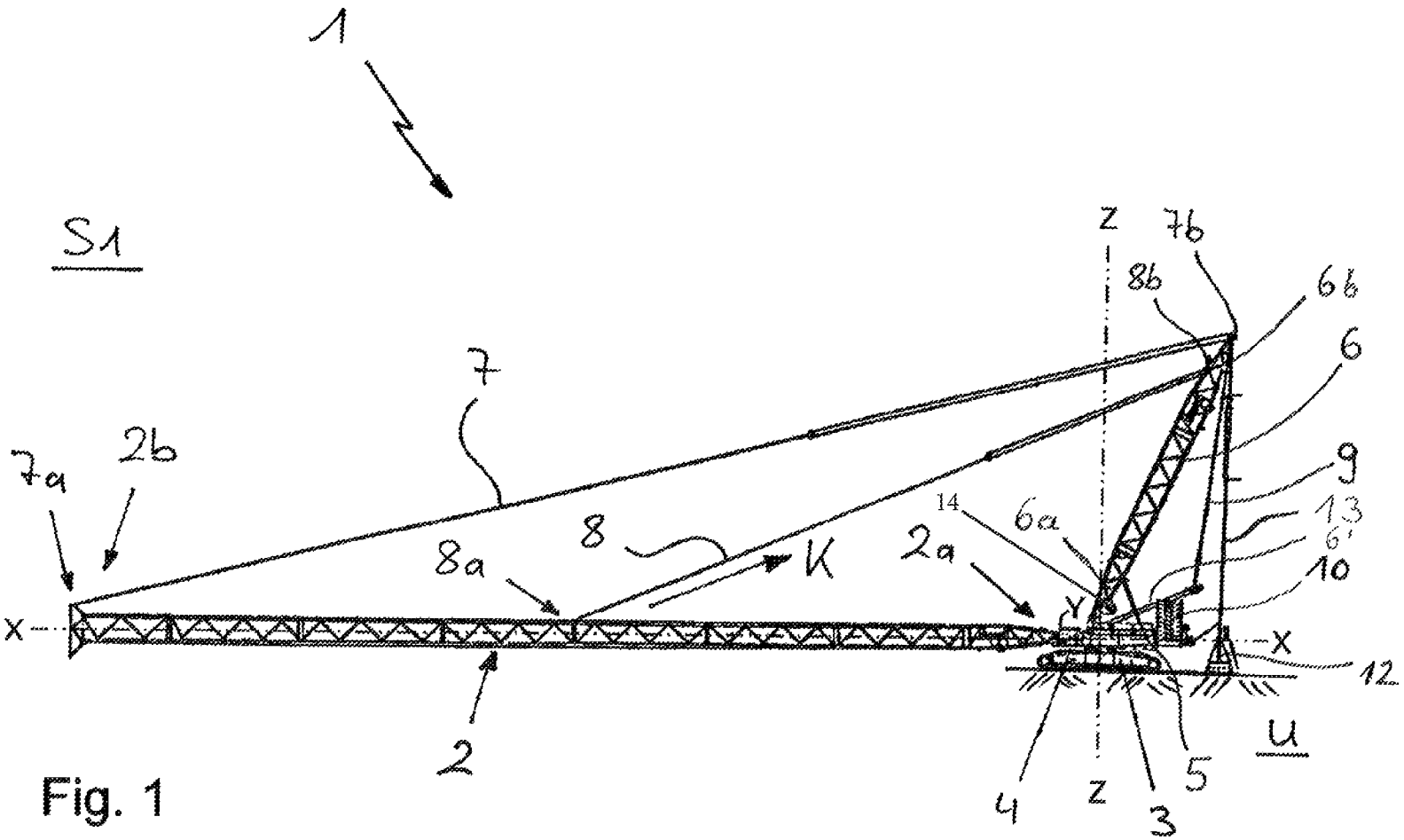
FIG. 1 shows a side view of a vehicle crane with its jib in an initial position.

FIG. 1 shows a vehicle crane 1 in accordance with the invention which is standing on ground U and comprises a long jib 2 extending in its longitudinal direction X. It can be seen that the jib 2 shown here by way of example is designed as an intrinsically jointless truss girder or lattice mast girder which, because it has no telescoping capability, has a length which is fixed in this respect. The jib 2 can be composed of one individual girder or of a plurality of girders connected to another in a bending-resistant manner. Furthermore, the vehicle crane 1 has a lower carriage 3 which has a crawler track 4 in the example shown here. Arranged on the lower carriage 3 is a superstructure 5 which carries the jib 2 and which can be rotated relative to the lower carriage 3 about a vertical axis Z. The jib 2 which extends in its longitudinal direction X is supported on the superstructure 5 by means of its foot 2*a* and is articulated in a luffable manner via a horizontal luffing axis Y in a vertical plane in order to raise, lower or luff the jib 2 during operation. Arranged in the region of a head 2*b* opposite the foot 2*a* of the jib 2 is a first connecting point 7*a* which is coupled to a main tensile connector or means 7. Depending upon the configuration, such a coupling can be a fastening, deflection or a combination thereof. The main tensile connector 7 is coupled oppositely to a head 6*b* of a counter jib 6 in a second connecting point 7*b*. This counter jib 6 is also referred to as a superlift jib or derrick mast. In this case, depending upon the configuration it is also possible for such a coupling to be a fastening, deflection or a combination. The counter jib 6 is typically also designed as a lattice mast girder and is luffably mounted on the superstructure 5. A further third connecting point 8*a* is arranged in a region of the jib 2 located between the first connecting point 7*a* and the foot 2*a* and is coupled, i.e. fastened and/or deflected, with a secondary tensile connector or means 8. The region for the third connecting point 8*a* is between 25% and 75%, preferably between 40% and 60%, of the length of the jib 2, as seen in the longitudinal direction X of the jib 2. Oppositely, the secondary tensile connector 8 is coupled, i.e. fastened and/or deflected, on the head 6*b* of the counter jib 6 in a fourth connecting point 8*b*. Therefore, the main tensile connector 7 and also the secondary tensile connector 8 each extend between the jib 2 and the counter jib 6. The counter jib 6 is connected via a rearward guying arrangement 9 to the superstructure 6 or a typical further counter jib 6' which is articulated at this location and is referred to as an A-block or support block. In the case of the types of set-up comprising a counter jib 6 and counter jib 6', the secondary tensile connector 8 is attached only to the head 6*a* of the counter jib 6. At its end opposite the jib 2, the superstructure 5 supports a counterweight 10. Also, an additional counterweight 12 which is also referred to as a superlift is suspended from the head 6*b* of the counter jib 6 via a suspension 13. As understood herein and in the art, the main tensile connector 7 and secondary tensile connector 8 may be cables, such as single cables or multiple cables running in parallel, cables used with pulley blocks, as described below, for tensioning the connector and/or adapting its length, or may be single or multiple rods or combinations thereof, or may be chains or belts.

In order to raise, luff during operation and lower the jib 2 at a later stage, the main tensile connector 7 and the secondary tensile connector 8 are variable in length in relation to the portion between the head 2*b* of the jib 2 and the head 6*b* of the counter jib 6. Pulley-block like reeving arrangements are typically provided for this purpose. In a corresponding manner, the main tensile connector 7 and the secondary tensile connector 8 are thus each fastened and deflected in their second and fourth connecting point 7*b*, 8*b* respectively. For the purpose of raising, luffing and lowering, the counter jib 6 is fixed in its operating position at a preselected angle on the superstructure 5 via the guying arrangement 9 and a support. The length of the main tensile connector 7 and the secondary tensile connector 8 is changed via winches 14 which are arranged on the superstructure 5 or on the foot 6*a* of the counter jib 6. The jib 2 which extends in its substantially horizontal initial position S1 can be vertically raised, luffed and then lowered by means of a corresponding change in the length of the main tensile connector 7. In parallel therewith, a tensile force in the form of a compensation force K is transmitted to the jib 2 by the secondary tensile connector 8 in order to reduce or compensate for the loading, in particular bending moments, which are produced from the empty weight of the jib 2 which is otherwise unsupported between the first connecting point 7*a* and its foot 2*a*. The control required for this purpose can be effected in many ways, including e.g. force-controlled or path-controlled, continuous, constant, linear or else stepwise. In this case, the control can take into consideration further features, such as e.g. the individual bearing load points and/or bearing load curves of the vehicle crane together with the respectively adopted rotation of its superstructure 5 relative to the lower carriage 3.

This tensile force is applied to the secondary tensile connector 8 preferably via a fastening winch. For this purpose, the fastening winch is driven electrically or hydraulically. It is also feasible for hydraulic tensioning cylinders to be used for this purpose which act upon the secondary tensile connector 8 directly, via cable drives or in a clamping manner.

In accordance with an aspect of the present invention and the exemplified embodiments, the lower end of the jib 2 having a length corresponding to 10% of the length of the entire jib 2 is understood as being in the region of the foot 2*a* of the jib 2. In the case of a jib 2 designed as a lattice mast, the lower end of the jib 2 thus comprises at least the so-called foot piece, with which the jib 2 is articulated to the superstructure 5, and the so-called first intermediate piece which adjoins thereto and which is then adjoined by the sequence of the lattice mast pieces of the jib 2. Even if, in the case of a short jib 2, the foot piece and the first intermediate piece exceed the defined 10% of the length of the entire jib 2, they form in any case the region of the foot 2*a* of the jib 2.

Figure 2:
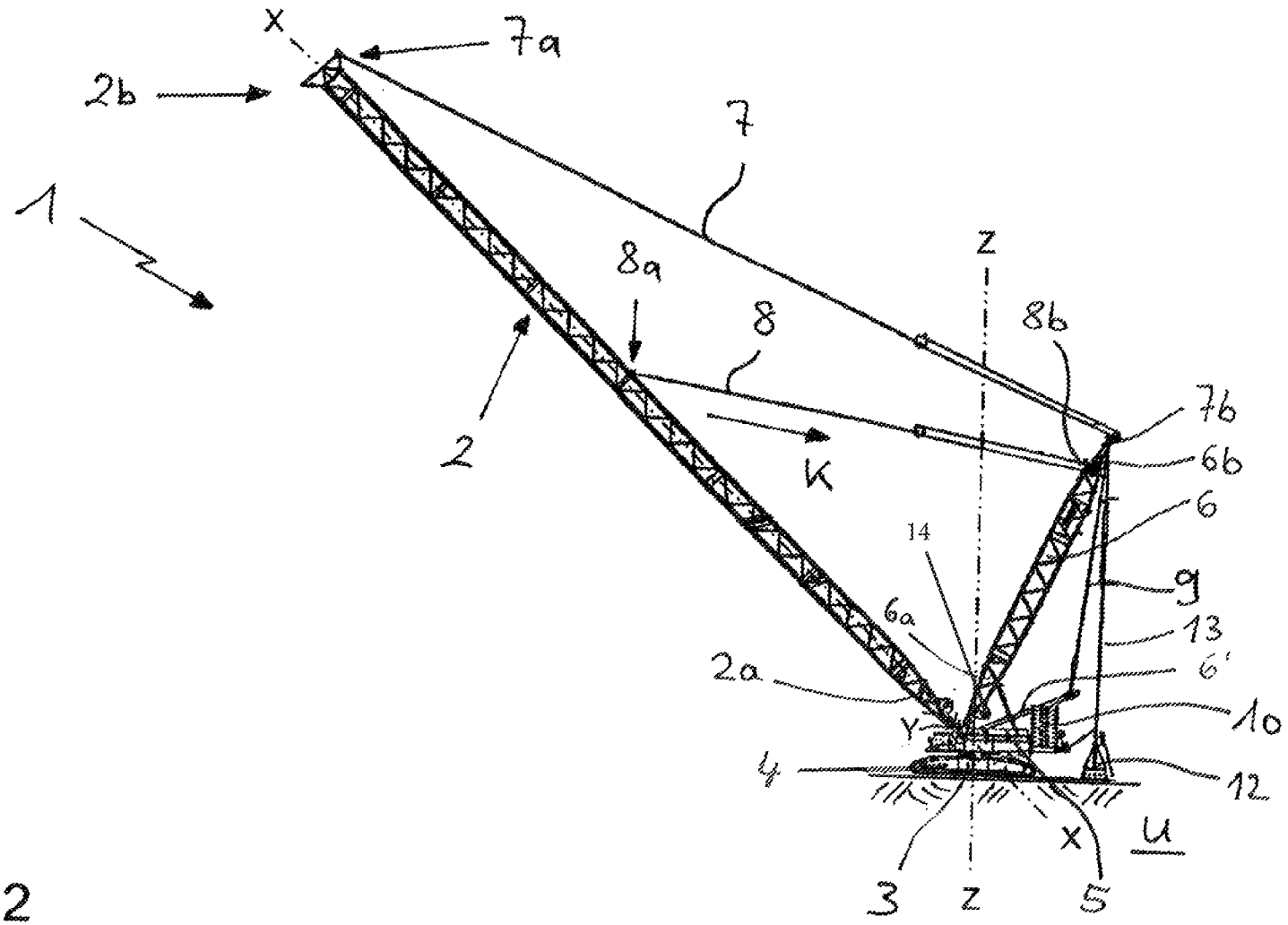
FIG. 2 shows the vehicle crane of FIG. 1 with its jib in a position raised with respect to the initial position, in an otherwise unchanged view.

FIG. 2 shows one of the raised positions S2 of the vehicle crane 1, of which the jib 2 has been raised in the previously described manner via the main tensile connector 7 and the secondary tensile connector 8. By reason of the relative length of the jib 2 which changes in this case in parallel with the ground U, the changing bending moments have been taken into consideration by the control, whereupon a corresponding adaptation of the compensation force K was effected via the secondary tensile connector 8 in a manner which cannot be seen more closely.

Figure 3:
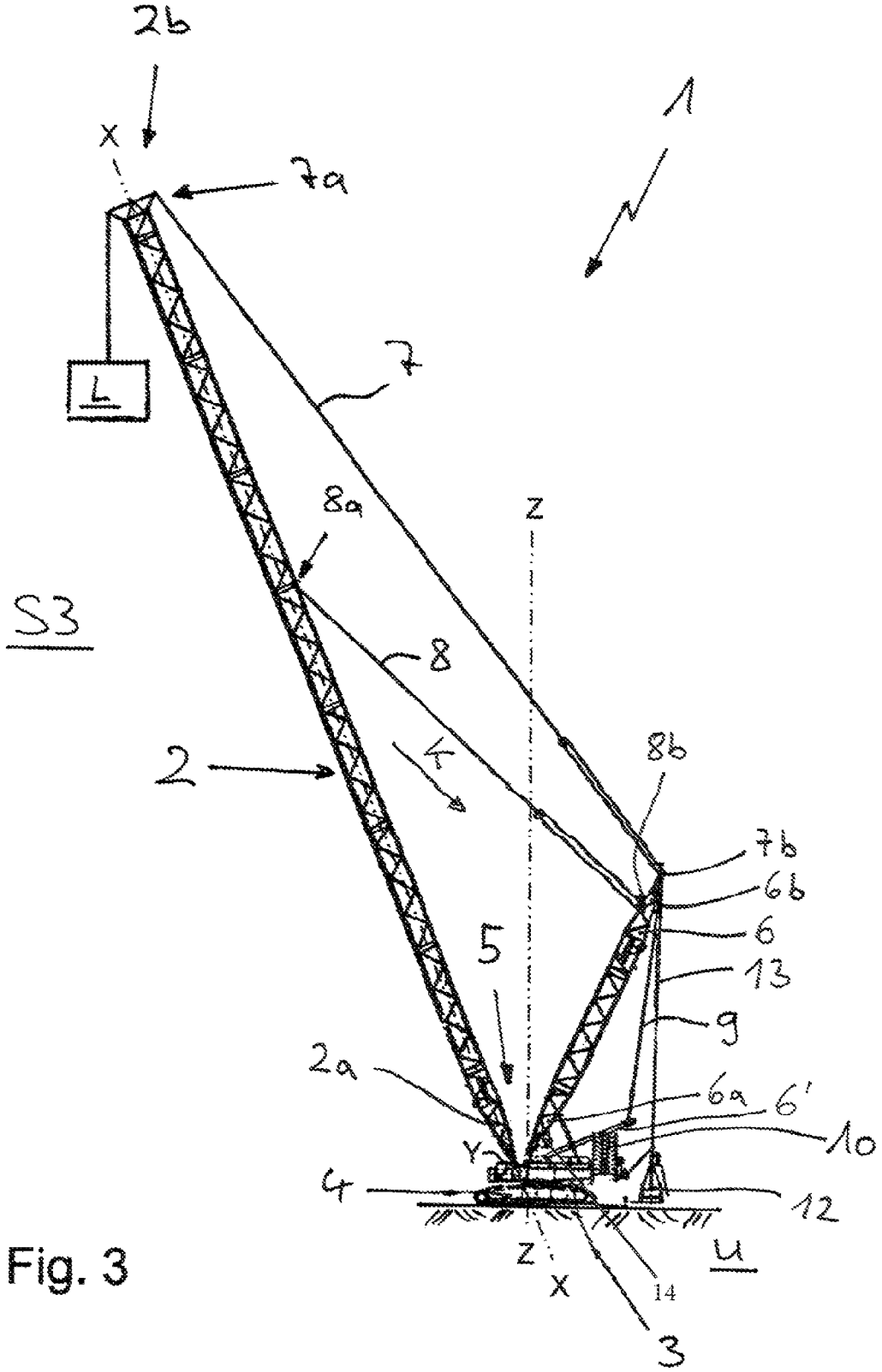
FIG. 3 shows the vehicle crane of FIG. 1 and FIG. 2 during the loading operation, in an otherwise identical view.

FIG. 3 illustrates an operating position S3 of the vehicle crane 1, in which its jib 2 has been raised to a relatively steep position in order to convey a picked-up load L. In the operating position S3, the jib 2 has a considerably shorter unsupported length, in particular in comparison with the initial position S1, wherein the compensation force K which can be transmitted via the secondary tensile connector 8 is now used primarily to increase its bearing load.

Figure 4:
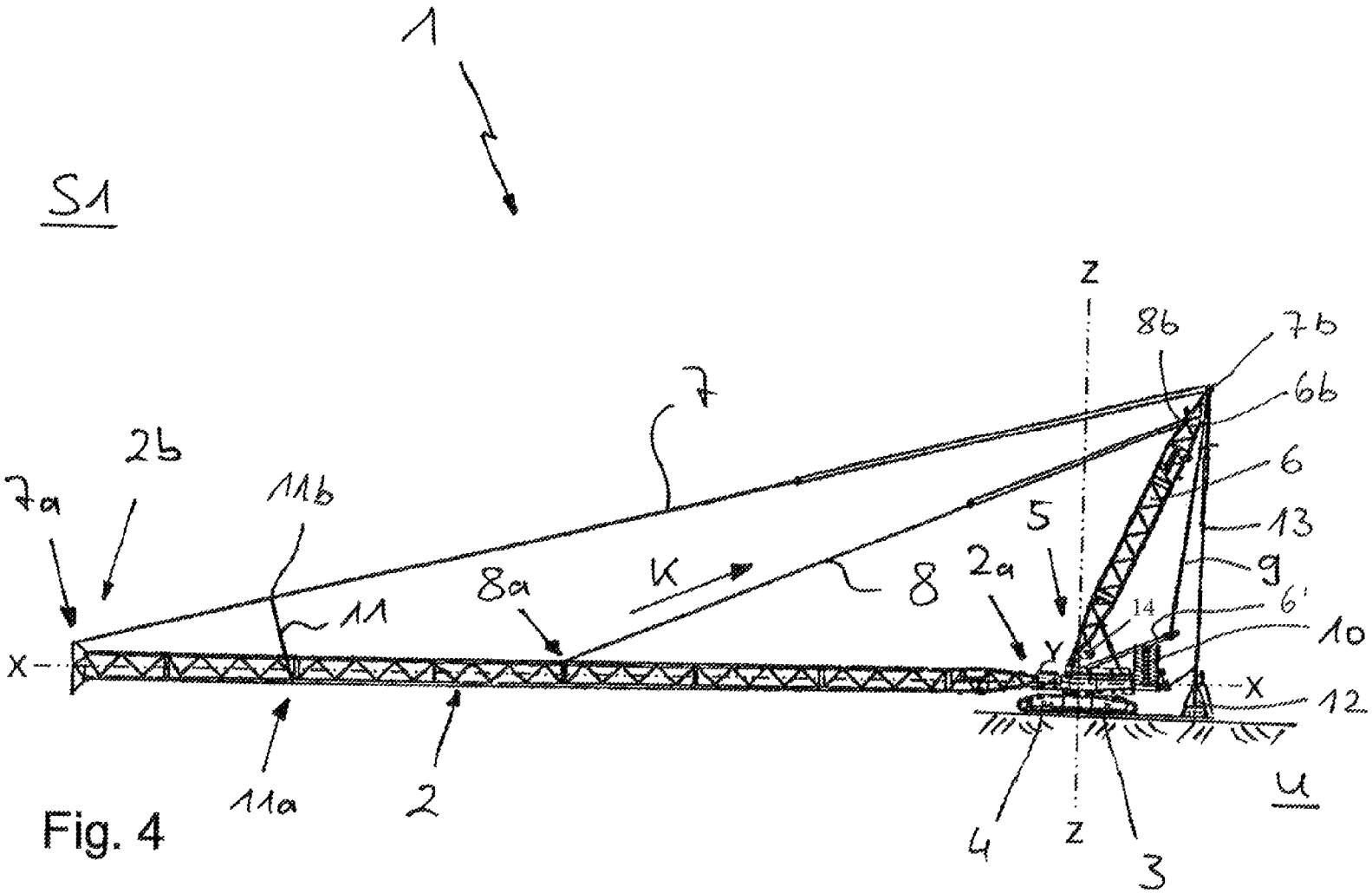
FIG. 4 shows the vehicle crane of FIG. 1 in a first alternative embodiment, in an otherwise identical view.

FIG. 4 shows the vehicle crane 1 once again in its initial position S1 already illustrated in FIG. 1. The vehicle crane 1 has an alternative configuration, in which its jib 2 has a further fifth connecting point 11*a* which is located in a region between the first connecting point 7*a* and the third connecting point 8*a*. In the present case, in order to achieve a further relieving of the loading on the jib 2 an auxiliary tensile connector or means 11 has been coupled to the fifth connecting point 11*a*, which is connected at its opposite end to the main tensile connector 7 in a sixth connecting point 11*b*. In this case, the auxiliary tensile connector 11 extends, starting from the sixth connecting point 11*b*, at an expedient angle, in particular at a right angle, to the main tensile connector 7, where the auxiliary tensile connector 11 may be constructed in like manner to the main tensile connector 7. The auxiliary tensile connector 11 thus extending between the fifth connecting point 11*a* and the sixth connecting point 11*b* on the main tensile connector 7 suspends the empty weight of the jib 2, which acts between the first connecting point 7*a* and the third connecting point 8*a*, quasi onto the main tensile connector 7, which, in spite of its natural flexibility in relation to the loading thus introduced therein, contributes to a further partial compensation for the bending moments in the jib 2. Fundamentally, it is also possible to use an auxiliary tensile connector 11 at a different location or to use more than one auxiliary tensile connector 11 which are arranged spaced apart along the jib 2. A first alternative could make provision to position the third connecting point 8*a* for the individual secondary tensile connector 8 closer to the head 2*b* of the jib 2 and to provide the fifth connecting point 11*a* in a region between the third connecting point 8*a* and the foot 2*a* of the jib 2.

Figure 5:
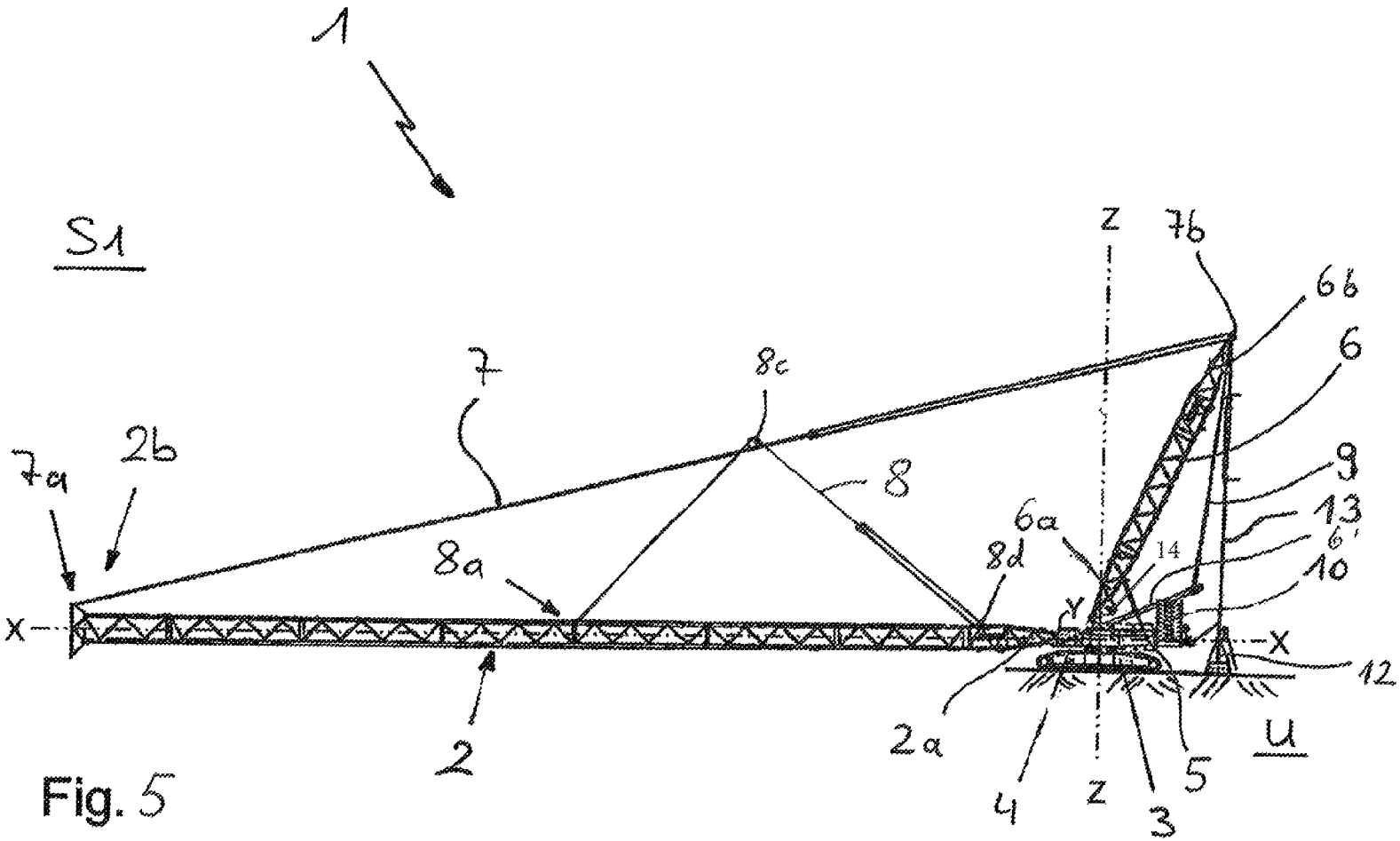
FIG. 5 shows the vehicle crane of FIG. 1 in a second alternative embodiment, in an otherwise identical view.

FIG. 5 shows a second alternative embodiment of the inventive vehicle crane of FIG. 1, in an otherwise identical view. In comparison with FIG. 1, the progression of the secondary tensile connector 8 has been selected differently. The secondary tensile connector 8 is fastened to the jib 2 in its third connecting point 8*a* at a location comparable to that in FIG. 1. From here, the secondary tensile connector 8 is not guided in the direction of the head 6*b* of the counter jib 6 as in FIG. 1 but instead, as known from the auxiliary tensile connector 11 of FIG. 4, is guided at an angle of less than 90°, which is inclined in the direction of the counter jib 6, to a seventh connecting point 8*c* to the main tensile connector 7. This angle can also be 90° if necessary. In the seventh connecting point 8*c* on the main tensile connector 7, the secondary tensile connector 8 is deflected and guided further in the direction of the foot 2*a* of the jib 2 in order to be coupled at this location in the region of the foot 2*a* in an eighth connecting point 8*d*. Starting from the eighth connecting point 8*d*, the secondary tensile connector 8 also forms in this case an angle of less than 90° to the jib 2. Since also in this case, in order to adjust the length of the secondary tensile connector 8, the secondary tensile connector 8 is formed, at least between the seventh connecting point 8*c* and the eighth connecting point 8*d*, in the manner of a pulley block with a corresponding reeving arrangement, the secondary tensile connector 8 in the eighth connecting point 8*d* is diverted on the one hand and is guided on the one hand once or multiple times back in the direction of the seventh connecting point 8*c* and is guided on the other hand further in the direction of the associated winch mechanism on the superstructure 5 or on the foot 6*a* of the counter jib 6. Fundamentally, it is also possible to arrange a winch mechanism in the region of the foot 2*a* in order to adjust the length of the secondary tensile connector 8 and thus replace the previously described pulley block-like formation.

Figure 6:
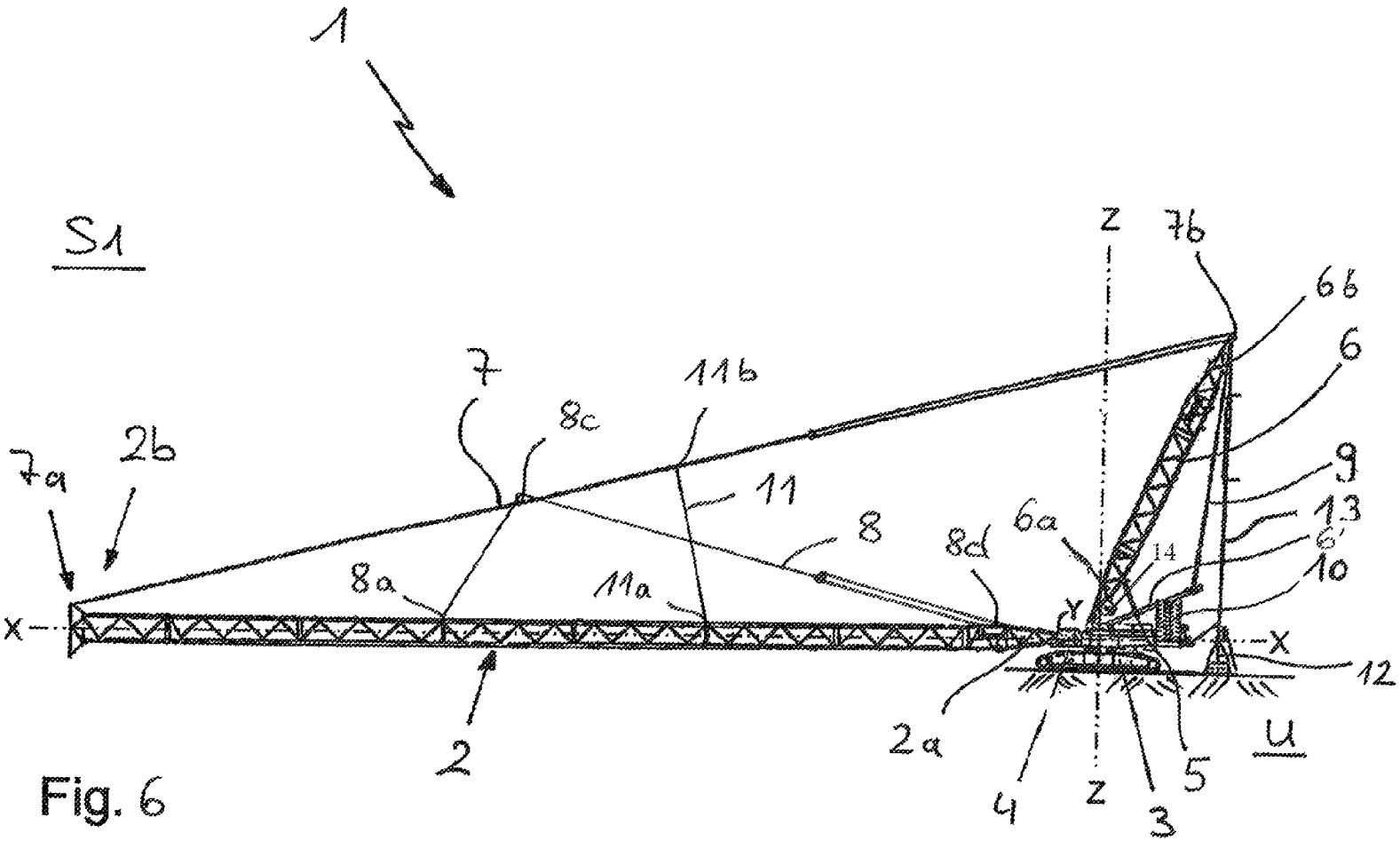
FIG. 6 shows the vehicle crane of FIG. 1 in a third alternative embodiment, in an otherwise identical view.

FIG. 6 shows a third alternative embodiment of the inventive vehicle crane 1 of FIG. 5 which corresponds substantially to the embodiment shown in FIG. 5. In order to achieve a further relieving of the loading on the jib 2, an auxiliary tensile connector 11 is coupled, in a manner comparable to FIG. 4, between a fifth connecting point 11*a* on the jib 2 and an opposite sixth connecting point 11*b* on the main tensile connector 7. In this case, the auxiliary tensile connector 11 extends, starting from the sixth connecting point 11*b* at a right angle to the main tensile connector 7. The fifth connecting point 11*a* is located in the region between the third connecting point 8*a* and the foot 2*a* of the jib 2. In this case, compared to the alternative shown in FIG. 5, the third connecting point 8*a* has been moved further in the direction of the head 2*b* of the jib 2. Fundamentally, it is also possible to use an auxiliary tensile connector 11 at a different location or to use more than one auxiliary tensile connector 11 which are arranged spaced apart along the jib 2.

Figure 7:
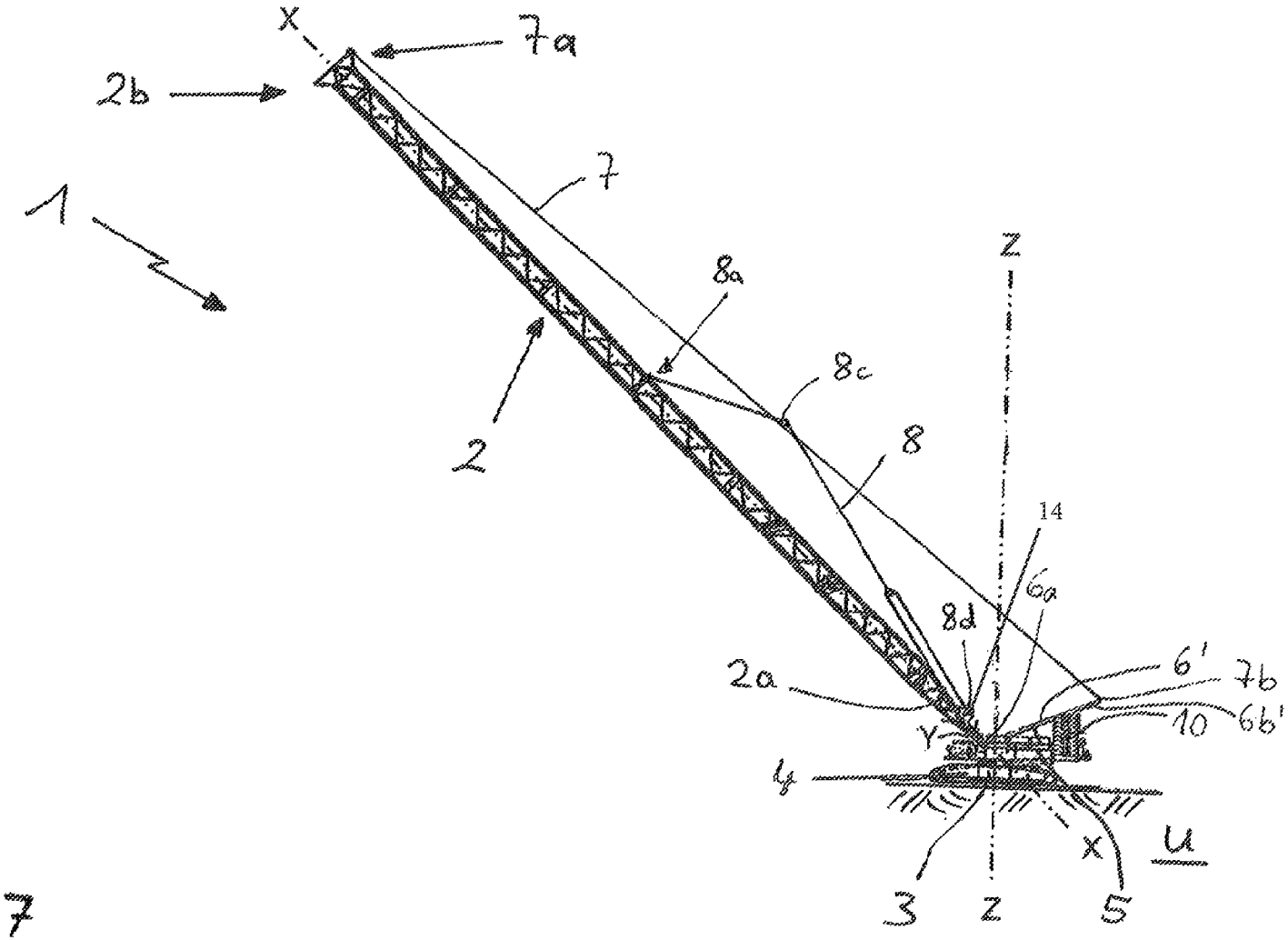
FIG. 7 shows the vehicle crane of FIG. 2 in a fourth alternative embodiment, in an otherwise identical view.

FIG. 7 shows a fourth embodiment of the inventive vehicle crane 1 of FIG. 2, in an otherwise identical view. In contrast to the view in FIGS. 1 to 6, the vehicle crane 1 is set up without a counter jib 6 designed as a superlift jib and is thus set up only with a counter jib 6', also referred to as an A-block, with a foot 6*a'* and a head 6*b'*. In this case, the main tensile connector 7 also extends, as shown in the previous FIGS. 1 to 6, starting from the region of the foot 2*a* of the jib 2 to the opposite head 2*b* of the jib 2. The progression of the secondary tensile connector 8 is comparable to that of FIG. 5. The secondary tensile connector 8 is fastened to the jib 2 in its third connecting point 8*a* at a point comparable to that in FIG. 1. From here, the secondary tensile connector 8 is not guided in the direction of the head 6*a'* of the counter jib 6' but instead is guided at an angle of less than 90°, which is inclined in the direction of the counter jib 6', to a seventh connecting point 8*c* to the main tensile connector 7. This angle can also be 90° if necessary. In the seventh connecting point 8*c* on the main tensile connector 7, the secondary tensile connector 8 is deflected and guided further in the direction of the foot 2*a* of the jib 2 in order to be coupled at this location in an eighth connecting point 8*d*. Starting from the eighth connecting point 8*d*, the secondary tensile connector 8 also forms in this case an angle of less than 90° to the jib 2. Since also in this case, in order to adjust the length of the secondary tensile connector 8, the secondary tensile connector 8 is formed, at least between the seventh connecting point 8*c* and the eighth connecting point 8*d*, in the manner of a pulley block with a corresponding reeving arrangement, the secondary tensile connector 8 in the eighth connecting point 8*d* is deflected on the one hand and is guided on the one hand once or multiple times back in the direction of the seventh connecting point 8*c* and is guided on the other hand further in the direction of the associated winch mechanism 14 on the superstructure 5 or on the foot 6*a'* of the counter jib 6'.

In conjunction with the invention, the main tensile connector 7 and also the secondary tensile connector 8 can each be articulated to the tip of the head 2*b* of the jib 2 or the head 6*b*, 6*b'* of the counter jib 6, 6' or in the region thereof. The term region is hereby understood to be a portion starting from the respective outer end of the jib 2, 6, 6' inwards with a length of up to 10% of the entire length of the respective jib 2, 6, 6'. The same applies to the connecting points on the foot 2*a*, 6*a*, 6*a'* of the jib 2, 6, 6'.

In conjunction with the previously described exemplified embodiments shown in FIGS. 1 to 7, the third connecting point 8*a* for the secondary tensile connector 8 is illustrated in the drawings always in the region of a top chord of the jib 2 designed as a lattice mast. For this purpose, it is fundamentally also possible for this third connecting point 8*a* to also be arranged in the region of a bottom chord of the jib 2 or in its so-called system centre line.

The embodiments of the invention in which an exclusive property or privilege is claimed are defined as follows:

1. A vehicle crane, said vehicle crane comprising:

a jib that can be raised and lowered by at least one main tensile connector, and a counter jib, wherein the main tensile connector extends between a first connecting point in the region of a jib head of the jib and a second connecting point in the region of a counter jib head of the counter jib;

wherein the jib has a third connecting point located between the first connecting point and a jib foot opposite the jib head, and wherein a secondary tensile connector extends between the third connecting point via a seventh connecting point on the main tensile connector and an eighth connecting point at the jib in the region of the jib foot.

2. The vehicle crane as claimed in claim 1, wherein the main tensile connector is variable in length.

3. The vehicle crane as claimed in claim 2, wherein the main tensile connector includes sections and is variable in length in the sections.

4. The vehicle crane as claimed in claim 1, wherein the secondary tensile connector is variable in length.

5. The vehicle crane as claimed in claim 4, wherein the secondary tensile connector includes sections and is variable in length in the sections.

6. The vehicle crane as claimed in claim 1, wherein the jib extends without joints between the jib foot and the jib head.

7. The vehicle crane as claimed in claim 1, wherein the jib has a plurality of girders or an individual girder extending between the jib foot and the jib head comprising lattice girders and/or box girders.

8. The vehicle crane as claimed in claim 1, wherein said vehicle crane has a superstructure that is arranged so as to be rotatable on a lower carriage and on which the jib is supported in a luffable manner via the jib foot.

9. The vehicle crane as claimed in claim 8, wherein the counter jib is supported on the superstructure.

10. The vehicle crane as claimed in claim 8, wherein one or both of the superstructure or the counter jib foot of the counter jib has a winch drive, and wherein the main tensile connector and the secondary tensile connector are each operatively connected to a said winch drive.

11. The vehicle crane as claimed in claim 1, wherein the jib has a fifth connecting point to which an auxiliary means is coupled, and wherein the auxiliary means is connected to the main tensile connector at a sixth connecting point.

12. The vehicle crane as claimed in claim 11, wherein the fifth connecting point is located between the foot of the jib and the third connecting point on the jib.

13. The vehicle crane as claimed in claim 1, wherein the region for the third connecting point, as seen in the longitudinal direction of the jib, is between 25% and 75% of the length of the jib.

14. The vehicle crane as claimed in claim 13, wherein the region for the third connecting point, as seen in the longitudinal direction of the jib, is between 40% and 60% of the length of the jib.

15. The vehicle crane as claimed in claim 1, wherein a counterweight is suspended from the counter jib.

16. The vehicle crane as claimed in claim 1, wherein the counter jib comprises a superlift jib and/or an A-block.

17. A method for reducing the loading on a jib of a vehicle crane, wherein the vehicle crane comprises the jib which can be raised and lowered by at least one main tensile connector, and a counter jib, wherein the main tensile connector extends between a first connecting point in the region of a jib head of the jib and a second connecting point in the region of a counter jib head of the counter jib, and wherein the jib has a third connecting point located between the first connecting point and a jib foot opposite the jib head with the jib being supported in a luffable manner via the jib foot, and wherein a secondary tensile connector extends between the third connecting point via a seventh connecting point on the main tensile connector and an eighth connecting point at the jib in the region of the jib foot, said method comprising:

loading the jib during operation and/or during raising and lowering; and transmitting a compensating force to the jib at the third connecting point by the secondary tensile connector coupled to the third connecting point.

18. The method as claimed in claim 17, wherein said transmitting a compensating force to the jib further comprises controlling the compensating force.

19. The method as claimed in claim 18, wherein the compensation force to be transmitted is controlled in at least one of the following ways: force-controlled, path-controlled, continuously, constantly, linearly, stepwise.

20. The method of claim 18, wherein at least one of the following features of the vehicle crane is taken into consideration in said controlling the compensation force: bearing load points, loaded radius, counterweight radius, bearing load curve.

* * * * *